US005691506A

United States Patent [19]

Miyazaki et al.

[11] Patent Number: 5,691,506

[45] Date of Patent: Nov. 25, 1997

[54] GROUND STRUCTURE FOR SHIELD WIRE AND METHOD FOR GROUNDING WIRE

[75] Inventors: Sho Miyazaki; Fumiyoshi Tanigawa, both of Yokkaichi; Toshiyuki Sekimori; Yasuyoshi Fukao, both of Toyota, all of Japan

[73] Assignee: Sumitomo Wiring Systems Ltd., Mie, Japan

[21] Appl. No.: 524,562

[22] Filed: Sep. 7, 1995

[30] Foreign Application Priority Data

Sep. 27, 1994 [JP] Japan ..... 6-258920

[51] Int. Cl.[6] ..... H01R 9/05

[52] U.S. Cl. ..... 174/65 R; 439/98

[58] Field of Search ..... 174/65 R, 51, 174/35 C, 73.1, 74 R, 84 R; 439/98.99

[56] References Cited

U.S. PATENT DOCUMENTS

| | | | |
|---|---|---|---|
| 3,830,957 | 8/1974 | Oberdiear | 174/78 |
| 4,022,966 | 5/1977 | Gajajiva | 174/65 SS |
| 4,549,755 | 10/1985 | Kot et al. | 285/341 |
| 4,739,126 | 4/1988 | Gutter et al. | 174/65 SS |
| 4,895,525 | 1/1990 | Leonardo | 439/99 |
| 5,083,929 | 1/1992 | Dalton | 439/98 |
| 5,278,352 | 1/1994 | Schade | 174/65 SS |

FOREIGN PATENT DOCUMENTS

| | | | |
|---|---|---|---|
| 1 081 534 | 11/1960 | Germany . | |
| 86 00 598 | 2/1986 | Germany | H01R 9/05 |
| 37 08 493 | 6/1988 | Germany . | |
| 92 04 291 | 5/1992 | Germany | H01R 9/05 |
| 5-251116 | 9/1993 | Japan . | |

*Primary Examiner*—Kristine L. Kincaid
*Assistant Examiner*—Joseph Waks
*Attorney, Agent, or Firm*—Oliff & Berridge

[57] ABSTRACT

A ground structure for a shield wire that can withstand a pulling force to a certain degree includes notches formed through a peripheral wall of a housing defining a tubular member. Spring pieces are mounted respectively in the notches and project from the inner and outer peripheral surfaces of the housing. The housing is received in a shield cap, which is connected to a metal casing. When a shield wire, having an exposed braided wire exposed, is passed through the bore of the housing, the spring pieces contact the shield wire at the inner periphery of the housing and the shield cap at the outer periphery of the housing. Therefore, the braided wire and the metal casing are electrically connected together. Also, the shield wire is movable in an axial direction, so that the shield wire will not be broken even if a pulling force acts on the shield wire.

16 Claims, 5 Drawing Sheets

GROUND STRUCTURE FOR SHIELD WIRE AND METHOD FOR GROUNDING WIRE

BACKGROUND OF THE INVENTION

1. Field of the Invention

This invention relates to a ground structure for a shield wire having a braided wire and, more particularly, to an ground structure in which the braided wire is electrically connected to a metal casing.

2. Description of Related Art

FIG. 8 shows one conventional ground structure of this type for a shield wire, which is disclosed in Japanese Unexamined Patent Publication No. 5-251116.

The ground structure disclosed in this publication comprises an inner cylindrical ring 3 of a conductive material having an inner diameter substantially equal to an outer diameter of an inner wire 2 of the shield wire 1, an outer cylindrical ring 6 that has a tapering bore flaring from one end thereof, which has an inner diameter substantially equal to an outer diameter of a sheath 5 of the shield wire 1, toward the other end thereof, and screws 8 for fastening the outer ring 6 to a metal casing 7. The metal casing 7 has a through hole 9 that allows the inner wire 2 to pass therethrough but does not allow the inner ring 3 to pass therethrough.

The shield wire 1 is first passed at its front end portion through the smaller-diameter end of the outer ring 6, and the inner ring 3 is fitted on the front end portion of the shield wire 1 in such a manner that a distal end of the inner ring 3 is inserted in between the inner wire 2 and a braided wire 4. As the inner wire 2 of the shield wire 1 is passed through the through hole 9 in the metal casing 7, the other end of the inner ring 3 is brought into engagement with a surface of the metal ring 7 around the through hole 9. Then, the outer ring 6 is moved toward the metal casing 7 and fastened to the casing by the screws 8. The braided wire 4 is held between the distal end of the inner ring 3 and the smaller-diameter end of the outer ring 6 so that the braided wire 4 is electrically connected to the inner ring 3. Also, the other end of the inner ring 3 is held against and electrically connected to the surface of the metal casing 7 around the through hole 9 so that the braided wire 4 is electrically connected to the metal casing 7.

In the above conventional ground structure for the shield wire, the end portion of the shield wire 1 is completely fixed relative to the metal casing 7. Therefore, when the shield wire 1 is pulled instantaneously, the shield wire itself must withstand such a pulling force; otherwise the shield wire 1 would be broken.

SUMMARY OF THE INVENTION

The present invention has been made in view of the above problem, and an object of the invention is to provide a ground structure for a shield wire that can withstand a pulling force to a certain degree.

The above object has been achieved by a shield wire ground structure wherein the shield wire, including an inner wire covered with an insulating member, a braided wire covering the inner wire, and an insulating member covering an outer periphery of the shield wire, is passed through a through hole in a metal casing. The braided wire is electrically connected to the metal casing, thereby grounding the shield wire. The ground structure includes a shield ring of a conductive material that has a double-wall tubular construction having two walls and firmly holds the braided wire of the shield wire between the two walls, a first tubular member of a conductive material in which the conductive shield ring is inserted with a predetermined space formed therebetween, one end of the first tubular member being connected to the metal casing, and spring pieces of a conductive material that are held within the first tubular member and resiliently contact an inner surface of the first tubular member and an outer surface of the conductive shield ring.

The shield wire ground structure may include a second tubular member that enables the shield wire to pass therethrough, the second tubular member being insertable into the first tubular member. Notches are formed in a peripheral wall of the second tubular member, and the spring piece are held in respective notches in such a manner that each the spring pieces projects from inner and outer surfaces of the peripheral wall of the second tubular member.

The shield wire ground structure may include a rubber plug provided between the shield wire and the first tubular member.

According to a second aspect of the invention, there is provided a shield wire ground structure wherein a shield wire, including an inner wire covered with an insulating member, a braided wire covering the inner wire, and an insulating member covering an outer periphery of the shield wire, is passed through a through hole in a metal casing, and the braided wire is electrically connected to the metal casing, thereby grounding the shield wire. A tubular member of a conductive material is connected to the metal casing, spring pieces of metal are formed on the metal casing and directed toward an inner peripheral surface of the tubular member, the braided wire of the shield wire is firmly held between two walls of a shield ring of a conductive material, which has a double-wall tubular construction, and the shield wire is passed through the tubular member so that the-spring pieces are held in contact with the conductive shield ring.

The braided wire of the shield wire is clamped by the conductive shield ring of a double-wall tubular construction, and the shield wire is inserted into the first tubular member of the conductive material connected at one end to the metal casing so that the spring pieces held within the first tubular member resiliently contact the inner surface of the first tubular member and the outer surface of the conductive shield ring. As a result, the braided wire is electrically connected to the metal casing through the conductive shield ring, the spring pieces and the first tubular member. The spring pieces are held in slidable electrical contact with the outer periphery of the braided wire of the shield wire, and therefore, the shield wire can be moved axially.

The notches may be formed in the peripheral wall of the second tubular member through which the shield wire can be passed. The spring pieces are held in respective ones of the notches and project from the inner and outer surfaces of this peripheral wall. Therefore, when the second tubular member is inserted into the first tubular member, each spring piece projecting outwardly from the notch electrically contacts the inner peripheral surface of the first tubular member. On the other hand, when the shield wire, which has not only the conductive shield ring attached thereto but also the (exposed) braided wire, is inserted into the second tubular member, the spring pieces projecting inwardly from the peripheral wall to electrically contact the conductive shield ring.

The shield wire may be held by the first tubular member through the rubber plug, and therefore, a slight movement of the braided wire in the axial direction can be absorbed by the rubber plug. Also, a large movement can be dampened by displacement of the shield wire with respect to the rubber plug.

The shield wire may pass through the tubular member and may extend into the metal casing. The spring pieces are held against the outer periphery of the braided wire so that the shield wire can be moved in the direction of the axis of the tubular member.

As described above, in the present invention, the shield wire, passed through the first tubular member connected to the metal casing, can be moved in the axial direction, and therefore, even if the shield member is slightly pulled, this can be relieved by sliding movement of the shield member, thus achieving a shield wire ground structure in which the breakage of the shield wire is prevented.

When the spring pieces are held in respective ones of the notches in the second tubular member, a simple double tubular construction can be achieved.

When the shield wire is held by the rubber plug, the shield wire, when slightly moved, can be automatically returned to its initial position.

These and other advantages of the invention will be described in or apparent from the following detailed description of preferred embodiments.

BRIEF DESCRIPTION OF THE DRAWINGS

Preferred embodiment of the present invention will now be described with reference to the drawings, in which.

DETAILED DESCRIPTION OF PREFERRED EMBODIMENTS

Figure 1:
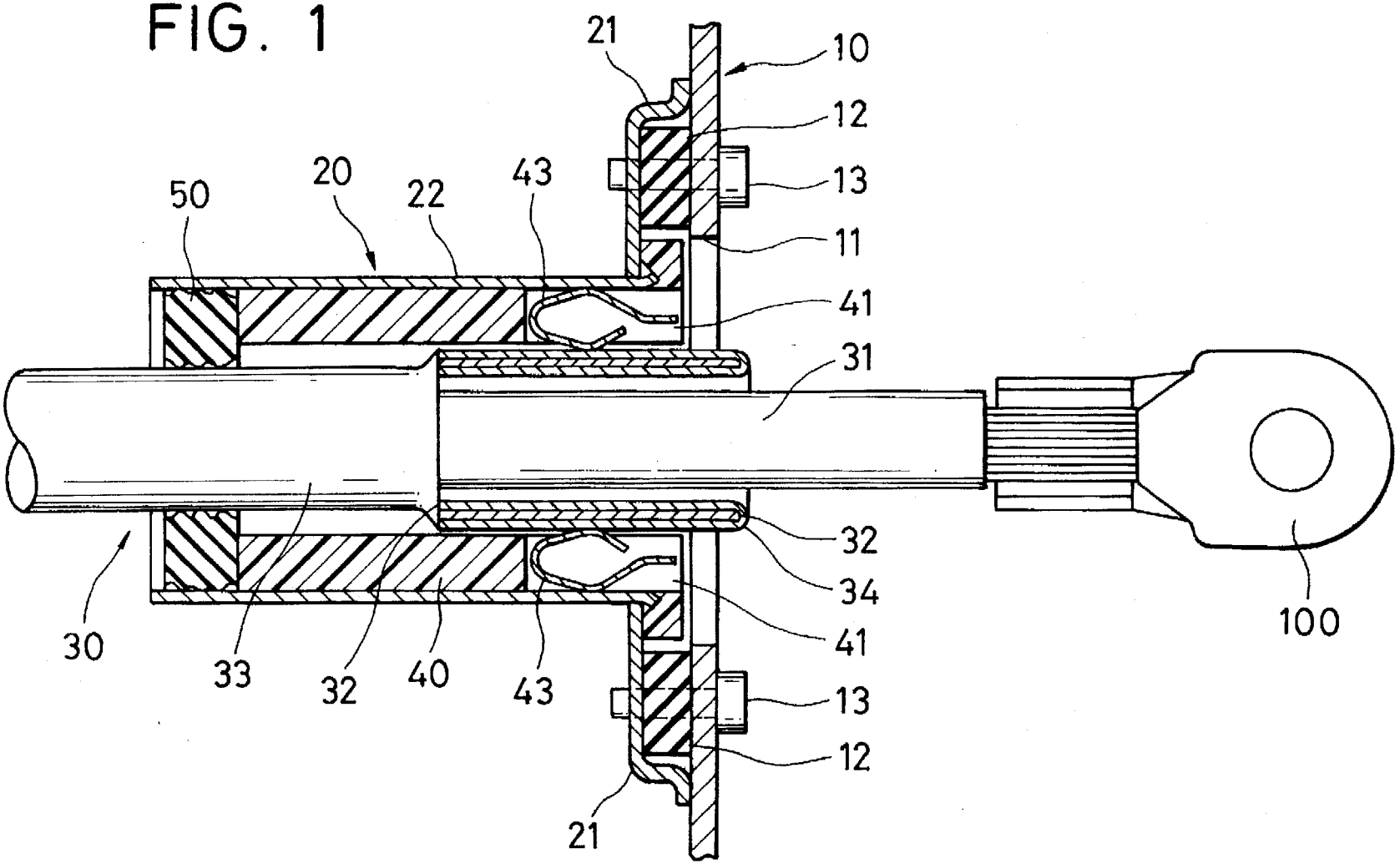
FIG. 1 is a cross-sectional view of one preferred embodiment of a ground structure of the invention for a shield wire.
Figure 2:
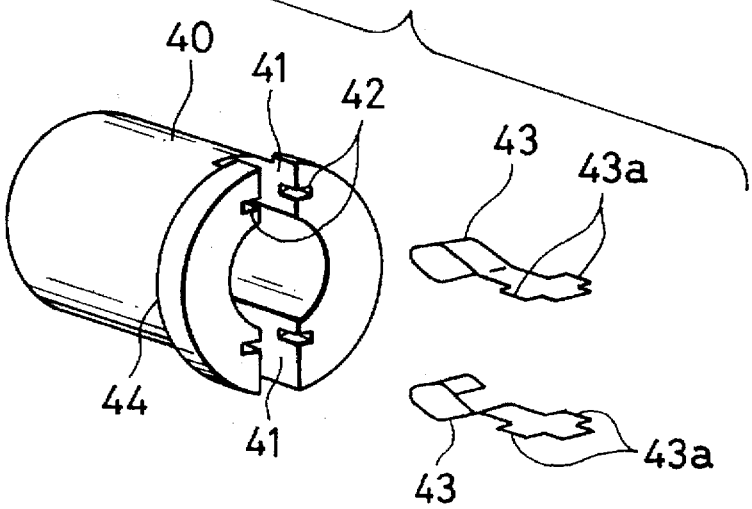
FIG. 2 is a perspective view of a housing.

FIG. 1 is a cross-sectional view of one preferred embodiment of structure of the invention for grounding a shield wire.

In FIG. 1, a metal casing 10 has a through hole 11 and a flange 21 for covering the through hole 11 formed on a tubular shield cap or first tubular member 20. An outer peripheral edge portion of the flange 21 is bent toward the metal casing 10 over an entire periphery thereof. The flange 21 is fastened by bolts 13 to the metal casing 10, with the outer peripheral edge thereof held against the surface of the metal casing 10, and a ring-shaped rubber packing 12 is interposed between the flange 21 and the metal casing 10. The rubber packing 12 is pressed against the metal casing 10 by the flange 21.

The shield cap 20 comprises a tubular member 22 of metal connected to the flange 21 by brazing, and a tubular housing or second tubular member 40 is received in the shield cap 20. The tubular housing 40 has an outer diameter generally equal to the inner diameter of the shield cap 20 and an inner diameter slightly larger than the outer diameter of the shield wire 30. The housing 40 is made of a resin, and a pair of wide notches 41 are formed in the open end of the housing 40 disposed adjacent to the metal casing 10 and extend toward the other end of the housing 40. In this embodiment, although two notches 41 have been shown, the number of the notches can be increased or decreased according to need.

Spring pieces 43 are held in the notches 41, respectively, each spring piece 43 having a front end portion bent into a rhombic cross-sectional shape. A pair of slits 42 is formed respectively in opposed surfaces of each notch 41, the slits being open to the open end of the housing 40. A pair of projections **43*a* are formed on opposite side edges of the rear end portion of each spring piece 43, and the width between the outer ends of the pair of projections 43*a* is greater than the width of the notch 41. As the spring piece 43 is inserted into the notch 41 with its front end first introduced thereunto, the projections 43*a* at the rear end portion of the spring piece 43 are press-fitted respectively into the pair of slits 42, thereby fixing the spring piece 43. The front end portion of the spring piece 43 is bent into a rhombic shape, and projects slightly from the outer peripheral surface of the housing 40, and also projects slightly from the inner peripheral surface of the housing 40. In this embodiment, the spring piece is bent into a rhombic shape, but the spring piece may be bent into a generally V-shape or other shape in so far as the spring piece can project slightly from the inner and outer peripheral surfaces of the housing. Although the spring pieces 43 are held on the housing by press-fitting, they may be held by other suitable means. Also, the housing 40 may be formed of metal, and the spring pieces 43 may be formed integrally with the metal housing. A flange 44 of a slightly larger diameter is formed on the housing 40 at one end thereof having the notches 41**.

Figure 3:
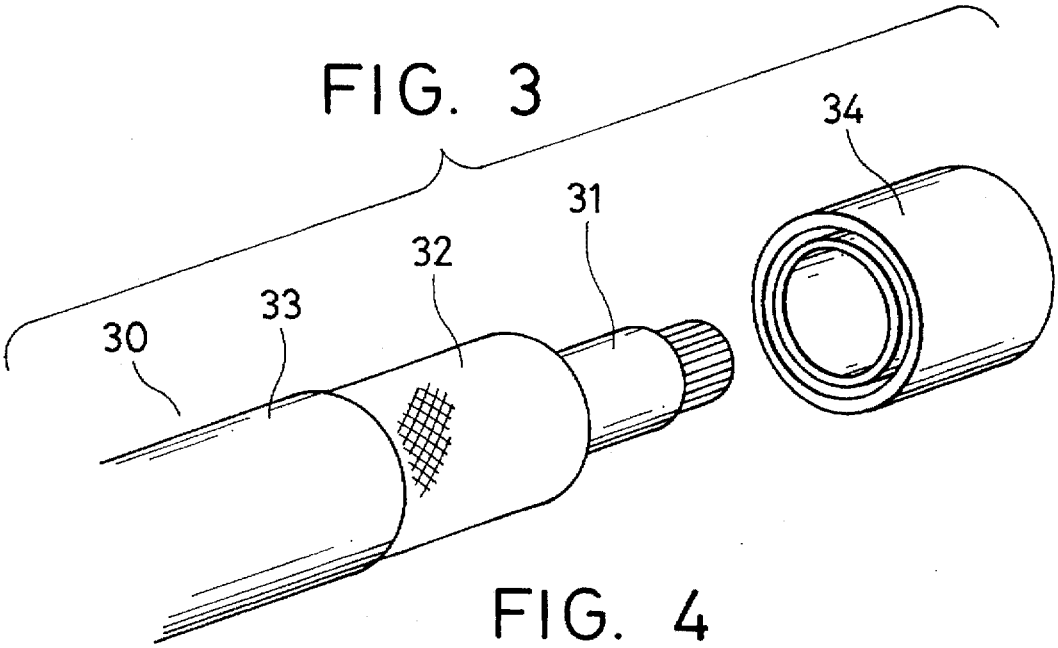
FIG. 3 is a perspective view of a shield wire.
Figure 4:
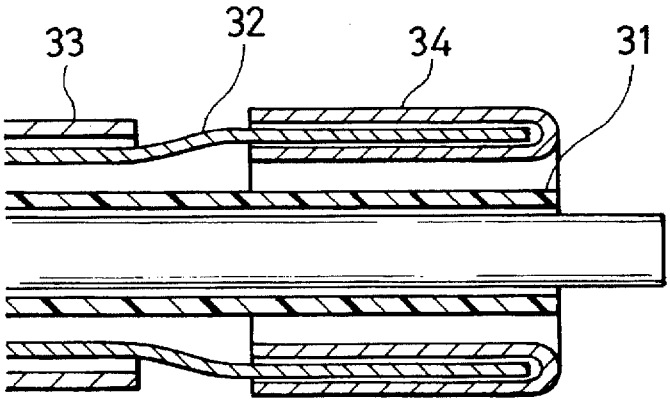
FIG. 4 is a cross-sectional view of the shield wire.

The shield wire 30 comprises an inner wire 31 having a number of conductors covered with an insulating member, a braided wire (outer conductor) 32 covering the outer periphery of the inner wire 31, and a sheath 33 of a resin covering the outer periphery of the braided wire 32. The layers on the conductors of the inner wire 31 are removed at end portion of the shield wire 30 in such a manner as to provide a stepped contour as shown in FIGS. 3 and 4, and a shield ring 34 is attached to the braided wire 32. The shield ring 34 is formed by folding back a single tubular member into a double-wall construction having a U-shaped cross-section. The front end portion of the braided wire 32 of a tubular shape is inserted into the gap between the two walls of the double-wall shield ring 34, and is fixedly held therebetween.

A tubular rubber plug 50 is fitted in the other open end of the shield cap 20 remote from the flange 21. Corrugations are formed respectively on inner and outer peripheral surfaces of the rubber plug 50, and the rubber plug 50 has an outer diameter slightly larger than the inner diameter of the shield cap 20 and an inner diameter slightly smaller than the outer diameter of the shield wire 30. Because of the provision of the corrugations, when the rubber plug 50 is inserted into the shield cap 20, the outer peripheral surface portion is slightly compressed to form a watertight seal. Also, when the shield wire 30 is passed through the rubber plug 50, the inner peripheral surface portion is slightly compressed to form a watertight seal.

The assembling of the above construction of this embodiment will now be described.

First, the spring pieces 43 are directed generally toward the flange 44, and are inserted respectively into the notches 41. The projections **43*a*, formed respectively on the opposite side edges of each spring piece 43, are brought into registry with the associated slits 42, respectively, and are press-fitted thereunto, so that the spring piece 43 is held in the notch 41**.

At this time, because the front end portion of the spring piece 43 is bent into a rhombic shape larger than the thickness of the peripheral wall of the housing 40, the front end portion projects slightly from the inner and outer peripheral surfaces of the housing 40.

The housing 40 is inserted into the shield cap 20 through the open end thereof on which the flange 21 is formed. Because the spring pieces 43 project from the outer peripheral surface of the housing 40 as described above, the spring pieces 43 electrically contact the inner peripheral surface of the shield cap 20, and also assist in fixing the housing 40 relative to the shield cap 20.

The shield wire 30 is first passed through the rubber plug 50, and the layers on the front end portion of the shield wire 30 are removed in a stepped manner. The front end portion is passed through the shield ring 34. At this time, the shield wire 30 is inserted into one end of the shield ring 34 remote from the folded end thereof, and the braided wire 32 is inserted into a gap between the inner and outer walls of the shield ring 34. When the braided wire 32 is thus inserted fully into the U-shaped gap as shown in FIG. 4, the shield ring 34 is compressed from the outside, thereby firmly holding the braided wire 32 between the two walls of the shield ring 34.

Then, the shield wire 30, having the shield ring 34 attached thereto, is inserted into the shield cap 20 through the end thereof remote from the flange 21. As the shield ring 34 is inserted into the housing 40, the spring pieces 43, projecting from the inner peripheral surface of the housing 40, are brought into contact with the outer peripheral surface of the shield ring 34, so that the spring pieces 43 hold the shield ring 34 from the opposite sides thereof, and are electrically connected thereto. The rubber plug 50 is forced into the shield cap 20 when the shield ring 34 is brought into registry with the spring pieces 43. The rubber plug 50 is compressed between the shield cap 20 and the shield wire 30, and an elastic restoring force resulting from this compression fixes the shield wire 30 against displacement with respect to the shield cap 20.

When the flange 21 of the shield cap 20 is fastened by the bolts 13 to the metal casing 10 with the rubber packing 12 interposed therebetween, the outer peripheral edge portion of the flange 21 is held against the metal casing 10, thus making an electrical connection therebetween. The braided wire 32 is fixedly secured to the shield ring 34, and is electrically connected thereto, the spring pieces 43 are held in electrical contact with the shield ring 34 and the inner peripheral surface of the shield cap 20, and the shield cap 20 is held in electrical contact with the metal casing 10 through the flange 21. Therefore, the braided wire 32 is electrically connected to the metal casing 10.

In this condition, when the shield wire 30 is pulled by vibrations or other external force, the rubber plug 50 holding the shield wire 30 is elastically deformed, so that the shield wire 30 is displaced axially relative to the shield cap 20. In accordance with this displacement, the shield ring 34 is also displaced in the axial direction; however, since the spring pieces 43 are slidingly held in contact against the outer peripheral surface of the shield ring 34, the shield wire 30 can be easily displaced. Then, when the external force ceases to act on the shield wire 30, the rubber plug 50 is restored into the initial position because of its elasticity. If such external force is large, the shield wire 30 is moved relative to the rubber plug 50 in the pulling direction, but the shield wire 30 can be easily returned into the initial position by forcing it back.

A terminal 100 may be connected to the front end of the inner wire 31 as shown in FIG. 1.

The notches 41 are formed in the housing 40, which defines the second tubular member, and extend through the peripheral wall thereof. The spring pieces 43 are mounted respectively in the notches 41 and project from the inner and outer peripheral surfaces of the housing 40. The housing 40 is received within the shield cap 20, which defines the first tubular member. The shield cap 20 is connected to the metal casing 10, and the shield wire 30, having the braided wire 32 (which together constitute a shield wire element) is passed through the bore of the housing 40, so that the spring pieces 43 are held against the shield wire 30 at the inner periphery of the housing 40 and are also held against the shield cap 20 at the outer periphery of the housing 40. Thus, the braided wire 32 is electrically connected to the metal casing 10, and the shield wire 30 is movable in the direction of the axis of the housing 40. Therefore even if a pulling force acts on the shield wire 30, the shield wire 30 will not be broken.

Figure 5:
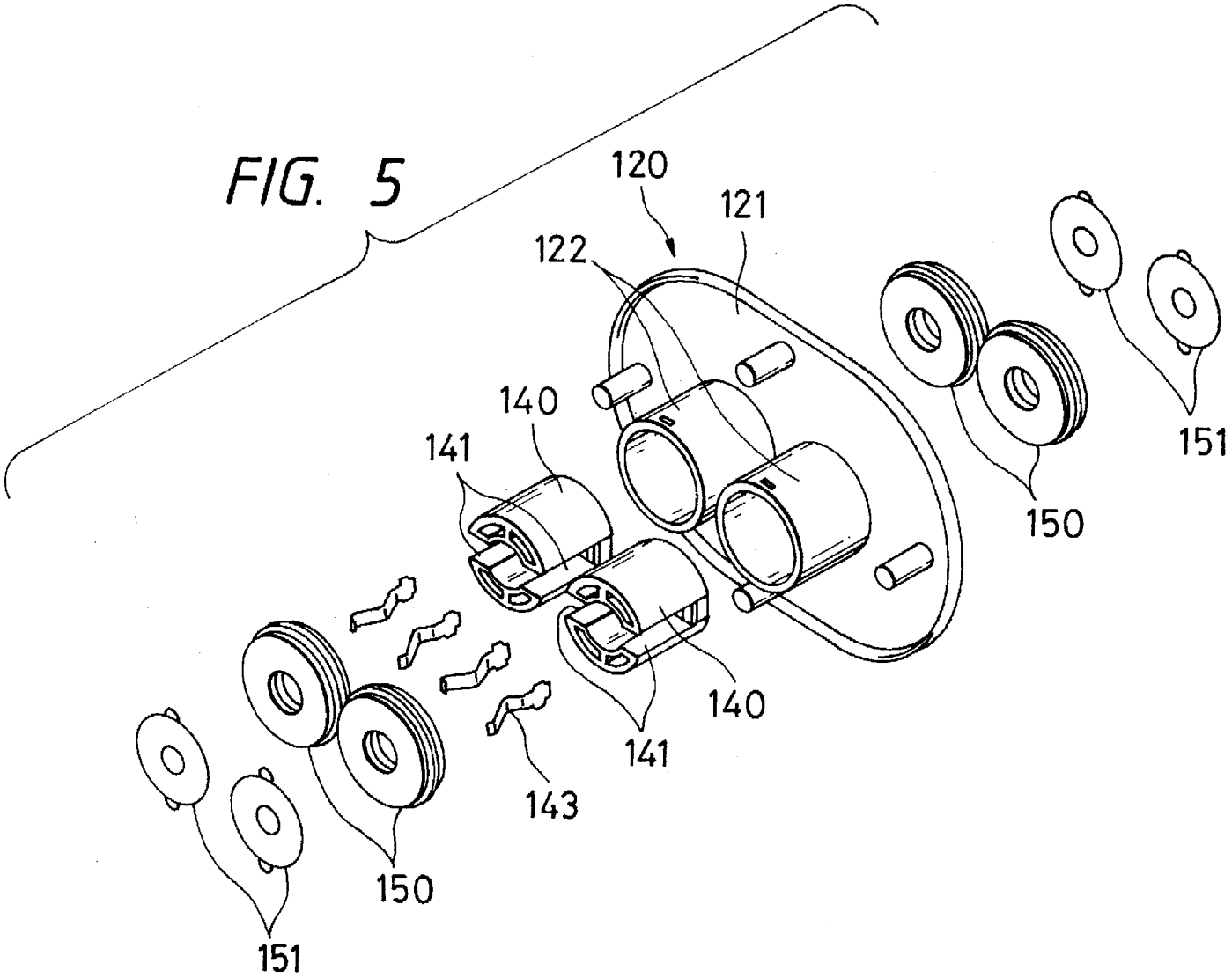
FIG. 5 is an exploded, perspective view of another embodiment of a ground structure of the invention for a shield wire.
Figure 6:
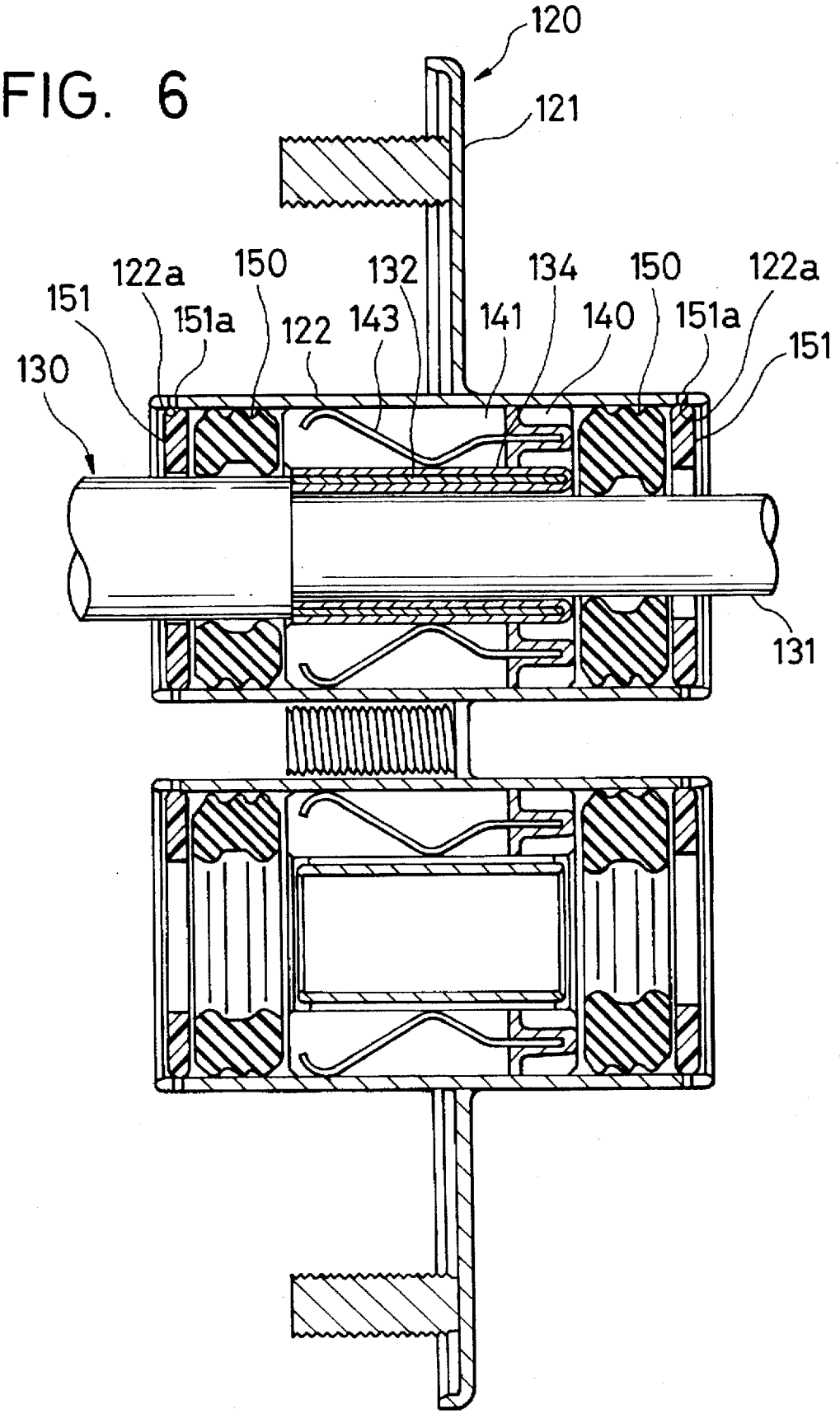
FIG. 6 is a cross-sectional view of the shield wire ground structure of FIG. 5.
Figure 7:
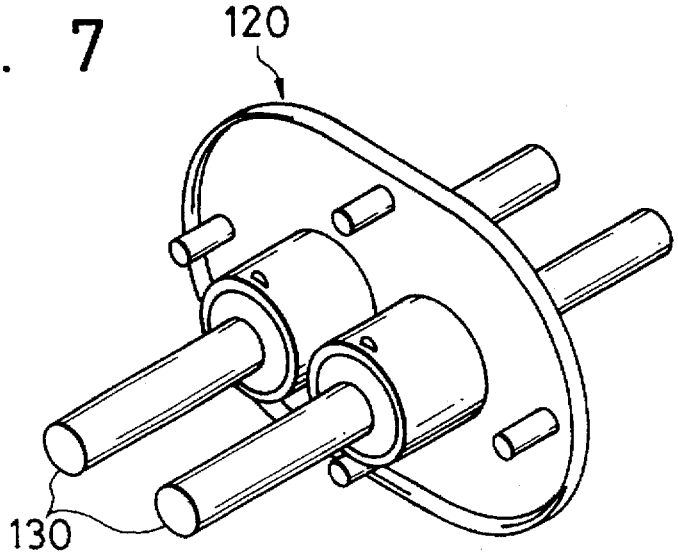
FIG. 7 is a perspective view of the shield wire ground structure of FIG. 5.
Figure 8:
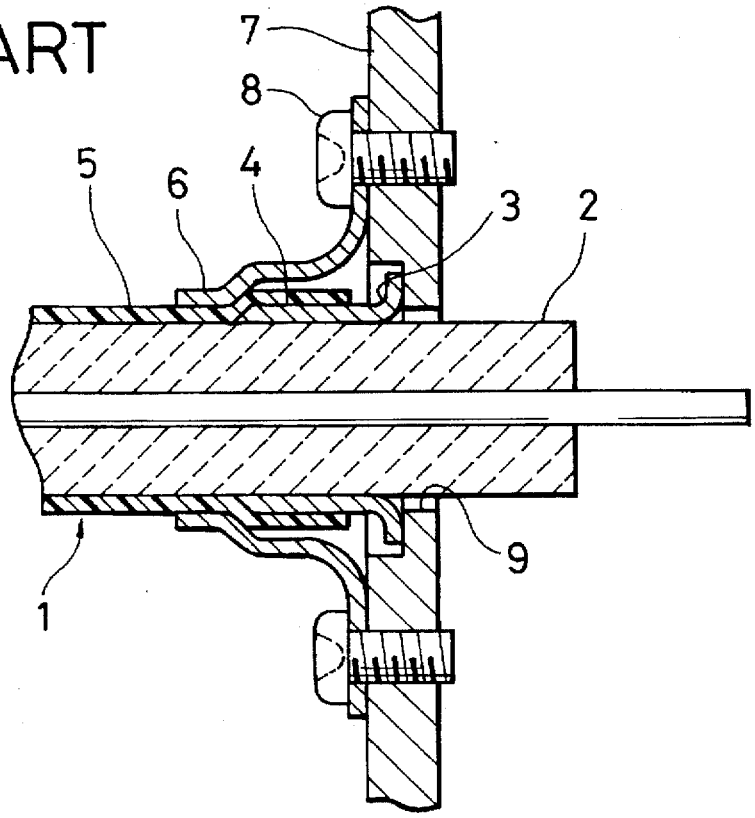
FIG. 8 RELATED ART
FIG. 8 is a cross-sectional view of a conventional shield wire ground structure.

FIGS. 5 to 7 show another embodiment of the invention.

A shield cap or first tubular member 120 comprises two tubular members 122 connected to a single flange 121 of a dish-shape, and a housing or second tubular member 140 is received in each of the two tubular members 122. As shown in FIG. 6, a pair of rubber plugs 150 are inserted respectively into opposite end portions of the housing 140, and a pair of disk-shaped retainers 151 are mounted in the housing 140 and disposed outwardly of the two rubber plugs 150, respectively, so as to prevent withdrawal of the rubber plugs 150. The outer diameter of the retainer 151 is generally equal to the inner diameter of the tubular member 122, and projections **151*a* are formed on the outer peripheral edge of the retainer 151. Recesses 122*a* corresponding respectively to the projections 151*a* are formed in the tubular member 122. The rubber plug 150 disposed inwardly of a metal casing has a slightly smaller inner diameter, and in a condition in which a braided wire 132 is exposed, the inwardly disposed rubber plug 150 is snugly fitted on an inner wire 131**.

In this embodiment, instead of the spring pieces 43 of a rhombic shape, spring pieces 143 of a generally V-shape are used, and each spring piece 43 is held in an associated notch 141 and press-fitted at one end into the housing 140. A bent portion of the spring piece 43 intermediate opposite ends thereof projects from the inner peripheral surface of the housing 140, and the other end of the spring piece 43 projects from the outer peripheral surface of the housing 140.

The spring pieces 143 are press-fitted in the housing 140, and the housing is inserted into the tubular member 122 of the shield cap 120, so that the ends of the spring pieces 143 contact the inner peripheral surface of the tubular member 122. Then, the two rubber plugs 150 are forced respectively into the opposite ends of the tubular member 122, and then the retainers 151 are inserted respectively into the opposite ends of the tubular member 122 to generally close these ends. A shield wire 130 having a shield ring 134 is inserted into the tubular member 122, and, when the shield ring 134 is positioned between the two rubber plugs 150, the intermediate portions of the spring pieces 143 contact the outer peripheral surface of the shield ring 134. As a result, the braided wire 132 is connected to the metal casing through the shield ring 134, the spring pieces 143 and the tubular member 122.

In this embodiment, because the two rubber plugs 150 are mounted respectively in the opposite ends of the housing 140, the pulling and pushing of the shield wire can be effectively accommodated.

The invention has been described with reference to preferred embodiments thereof, which are intended to be illustrative, not limiting. Various modifications will be apparent to those of ordinary skill in the art and are intended to be encompassed within the spirit and scope of the invention, as set forth in the appended claims.

What is claimed is:

1. A ground structure for a shield wire wherein the shield wire includes an inner wire covered with an insulating member, a braided wire covering said inner wire, and an insulating member covering an outer periphery of said shield wire, the shield wire being passed through a through hole in a metal casing, and said braided wire being electrically connected to said metal casing, thereby grounding said shield wire, said ground structure comprising:

a U-shaped shield ring of a conductive material that has a double-wall tubular construction having two walls, said shield ring firmly holding said braided wire of said shield wire between said two walls;

a first tubular member of a conductive material in which said shield ring is inserted with a predetermined space formed therebetween, one end of said first tubular member being connected to said metal casing; and spring pieces of a conductive material that are held within said first tubular member, said spring pieces resiliently contacting an inner surface of said first tubular member and an outer surface of said conductive shield ring.

2. A shield wire ground structure according to claim 1, further comprising a second tubular member enabling said shield wire to pass therethrough, said second tubular member being insertable into said first tubular member, said second tubular member including a peripheral wall including notches, said spring pieces being held respectively in said notches in such a manner that each of said spring pieces projects from inner and outer surfaces of the peripheral wall of said second tubular member.

3. A shield wire ground structure according to claim 1, further comprising a rubber plug provided between said shield wire and said first tubular member.

4. A ground structure for a shield wire in which the shield wire, including an inner wire covered with an insulating member, a braided wire covering said inner wire, and an insulating member covering an outer periphery of said shield wire, is passed through a through hole in a metal casing, said braided wire being electrically connected to said metal casing, thereby grounding said shield wire, said ground structure comprising:

a tubular member of a conductive material connected to said metal casing;

spring pieces of metal formed inside said tubular member, said spring pieces being directed toward an inner peripheral surface of said tubular member; and a U-shaped shield ring of a conductive material having a double-wall tubular construction for firmly grasping said braided wire;

wherein said shield wire passes through said tubular member, so that said spring pieces are held in contact with said conductive shield ring.

5. A structure for grounding a wire to a plate member, said structure comprising:

a first electrically conductive tubular member electrically connected to said plate member, said first tubular member surrounding said wire with a space therebetween;

at least one electrically conductive piece disposed within said space for electrically connecting the wire to the first tubular member; and means for maintaining electrical contact between the wire and the plate upon application of an axial pulling force on the wire.

6. A structure according to claim 5, wherein said wire includes an electrically conductive braided wire section, said structure further comprising an electrically conductive shield ring having a double-wall construction, said braided wire section being clamped between first and second walls of said double-wall construction, and wherein said first wall contacts said electrically conductive piece.

7. A structure according to claim 5, further comprising a second tubular member disposed within said first tubular member, said second tubular member including a flange having a recess for receiving said electrically conductive piece.

8. A structure according to claim 5, further comprising a rubber plug disposed within said first tubular member, said rubber plug including a through-hole for receiving said wire in a watertight manner.

9. A structure according to claim 5, wherein said electrically conductive piece is a substantially V-shaped member.

10. A structure according to claim 5, wherein said electrically conductive piece is a substantially rhombic-shaped member.

11. A structure according to claim 5, further comprising means for restoring said wire to an original position after said axial pulling force has been applied.

12. A method for electrically connecting a wire having a braided section to a grounding plate, said method comprising:

sliding a U-shaped shield ring of a double-wall construction over the wire;

inserting and clamping the braided section between walls of the double-wall construction;

surrounding said wire with a first tubular member in which a space is formed between the first tubular member and the wire;

electrically connecting the first tubular member to the plate; and providing the space between the first tubular member and the wire with at least one flexible, electrically conductive piece to electrically connect the shield ring to the first tubular member, thereby grounding the wire.

13. A method according to claim 12, further comprising maintaining said flexible conductive piece in electrical contact with the shield ring and the first tubular member upon relative axial movement between the wire and the first tubular member.

14. A method according to claim 12, further comprising providing a second tubular member within the first tubular member, and securing the flexible conductive piece within a recess of the second tubular member.

15. A method according to claim 12, further comprising absorbing axial pulling forces applied to the wire, and restoring the wire to an original position after application of the axial pulling forces.

16. A structure for grounding a wire to a plate member, said structure comprising;

a first electrically conductive tubular member electrically connected to said plate member, said first tubular member surrounding said wire with a space therebetween;

at least one electrically conductive piece disposed within said space for electrically connecting the wire to the first tubular member; and means for absorbing axial pulling forces applied to the wire and for maintaining electrical grounding contact during application of an axial pulling force.

* * * * *